United States Patent [19]

Mariol

[11] Patent Number: 4,505,686

[45] Date of Patent: Mar. 19, 1985

[54] CONVERTIBLE TOY

[76] Inventor: James F. Mariol, 481 Deanview Dr., Cincinnati, Ohio 45224

[21] Appl. No.: 459,210

[22] Filed: Jan. 19, 1983

[51] Int. Cl.[3] ..... A63H 17/00; A63H 17/05

[52] U.S. Cl. ..... 446/95; 446/434; 446/470; 446/478

[58] Field of Search ..... 272/52.5, 56, 56.5 R; 280/30; 14/2.4, 72.5; 410/24, 24.1, 53, 45; 446/95, 96, 434, 465, 470, 478, 487, 476, 471, 93, 94

[56] References Cited

U.S. PATENT DOCUMENTS

| | | | |
|---|---|---|---|
| 1,447,893 | 3/1923 | Roy | 14/2.4 X |
| 2,049,097 | 7/1936 | Winnemore . | |
| 2,218,394 | 10/1940 | Elliott . | |
| 3,039,229 | 6/1962 | Van Cleemput | 46/201 |
| 4,047,256 | 9/1977 | Hasara | 14/2.4 X |

*Primary Examiner*—Mickey Yu

*Attorney, Agent, or Firm*—Wood, Herron & Evans

[57] ABSTRACT

A toy transport set is disclosed which includes a toy truck having a cab and a trailer for carrying one or more toy vehicles, such as toy cars. The trailer is convertible from a transport configuration in which the trailer is releasably coupled to the cab, into a bridge configuration wherein the trailer forms a bridge having a relatively smoothly curving upper surface over which toy vehicles can move and under which toy vehicles may pass. The trailer has a main body portion with a substantially semi-circular upper exterior surface and a substantially flat bottom surface, and two end portions which are pivotally connected adjacent respective ends of the main portion. The end portions each have a surface having a concave contour matching a portion of the upper surface of the main body portion such that the end portions can be placed in facial engagement with the upper exterior surface of the main body portion. The end portions are otherwise squared off to define a trailer which is substantially rectangular in the transport configuration. The end portions can be pivoted outwardly from the main body portion into a bridge configuration converting the transport trailer into a bridge over which toy vehicles can move and pass under. The uncoupled cab also serves as a tow truck for a toy vehicle.

13 Claims, 4 Drawing Figures

CONVERTIBLE TOY

FIELD OF THE INVENTION

This invention relates generally to toys, and in particular to wheeled toys which are convertible to form various structures.

BACKGROUND OF THE INVENTION

The present invention relates to a type of toy which may be considered structural in form; that is, toys which are composed of various elements which can be rearranged to compose a variety of structures. Many of these toys are simply of the building block type, while others are of a convertible type which convert from one object to another by the substitution of a new member or a limited number of members for one or more members of the original assembly.

Structural toys of the foregoing type, besides being generally amusing to a child, are also considered beneficial to a child's education through the familiarization of the child with structural dynamics and the interrelationship of various objects and shapes. Such toys are thus designed with an eye towards flexibility and versatility as well as novelty in the configurations which can be made with the toy.

SUMMARY OF THE INVENTION

In view of the foregoing general advantages obtainable from structural toys, it was considered desirable to design a toy having a plurality of interrelated elements which is particularly adaptable to two configurations which are immediately recognizable yet of disparate function. To this end, the instant toy transport set was devised having a trailer which is capable of functioning as a wheeled transport for one or more toy vehicles, and which is further convertible into a bridge over and under which the vehicles may pass.

It is thus a general object of this invention to provide a convertible toy which is capable of being converted from one specific configuration to another. A further object is to provide a toy which in one of its configurations is a wheeled toy and in another is a bridge structure.

Yet another object is to provide a toy transport set having at least one toy vehicle, such as an automobile, which is carried on a truck having a cab and trailer, wherein the trailer is convertible into a bridge over which the toy vehicle can travel when the trailer is uncoupled from the cab.

Still a further object is to provide for the convertibility between configurations through the use of interconnected portions forming the trailer to thereby facilitate formation of the two configurations by a young child.

These and other objects and advantages are accomplished by the present invention in a toy transport set which comprises a toy truck having a cab and a trailer, wherein the trailer is convertible from a transport configuration for carrying one or more toy vehicles into a bridge configuration wherein the trailer becomes a bridge which a toy vehicle can travel over and under. To this end, the trailer is formed with a main body portion which has a substantially semi-circular upper exterior surface and a substantially flat bottom surface, and two end portions which are pivotally connected adjacent respective ends of the main body portion. The end portions are complimentarily tapered along one surface to match the upper exterior surface of the main body portion, each having a concave contour matching a portion of the upper surface of the main body portion such that the end portions can be pivotally placed in facial engagement therewith and in a transport configuration to form a wheeled trailer. The end portions when pivoted outwardly from the main body portion form the bridge configuration transforming the transport trailer into a bridge having a substantially smooth upwardly facing surface over which the toy vehicles can move. The toy vehicles can further pass beneath the bridge so formed since the middle body portion is supported and suspended between the two end portions.

The uncoupled cab in combination with a toy vehicle further functions as a tow truck.

The foregoing objectives, features and advantages of the present invention will be more readily understood upon consideration of the following detailed description of the invention taken in conjunction with the accompanying drawings, in which:

DETAILED DESCRIPTION OF AN EMBODIMENT OF THE INVENTION

Figures 1, 2, 2A, 3:
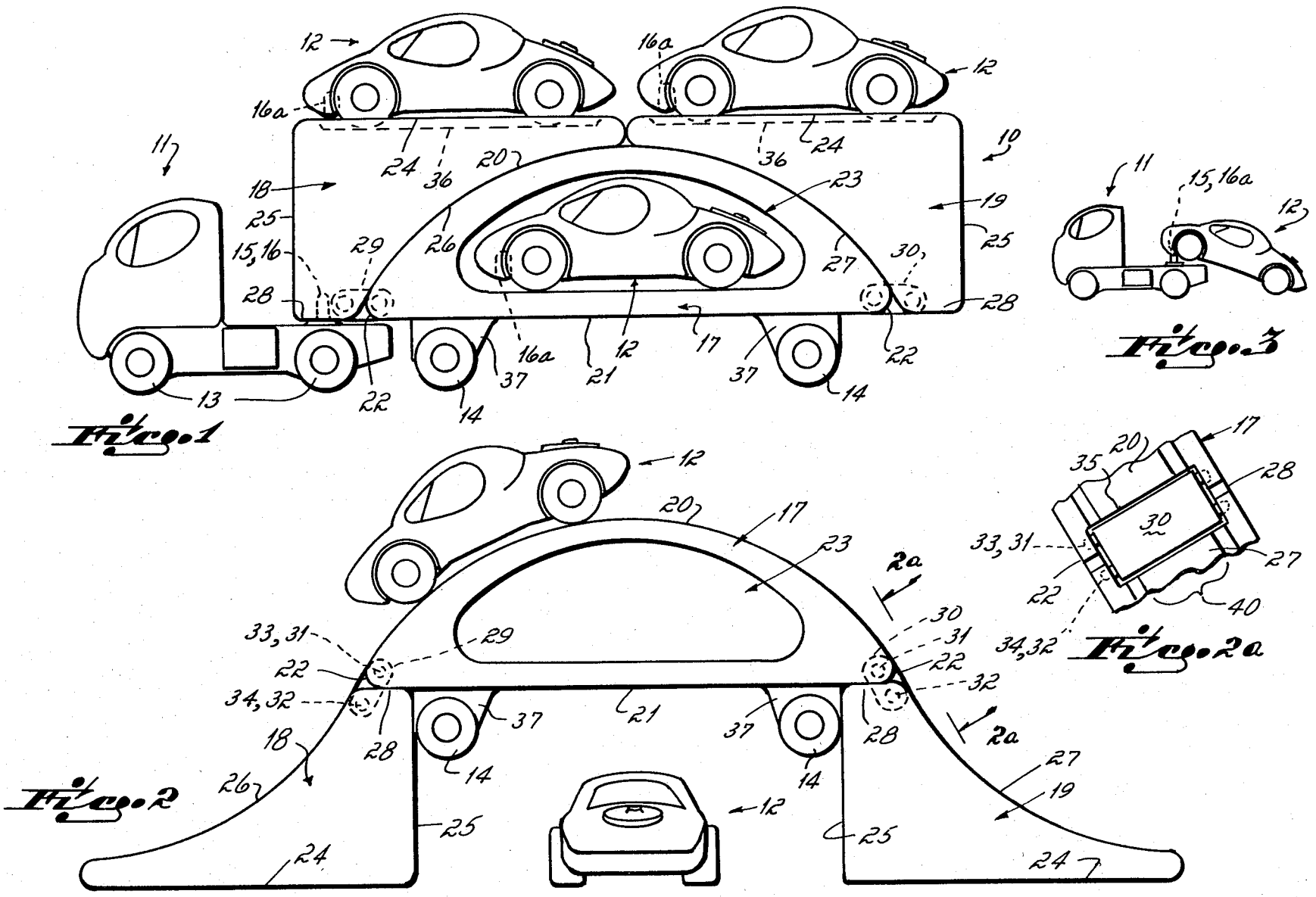
FIG. 1 is a side elevational view of a toy transport set made in accordance with the principles of this invention with the trailer in a transport configuration for carrying a plurality of toy vehicles.
FIG. 2 is a side elevational view of the trailer of FIG. 1 converted into a bridge configuration.
FIG. 2*a* is a detailed view of the link arrangement, looking from the right of FIG. 2 along line 2*a*—2*a*.
FIG. 3 is a side elevational view of the cab employed as a tow truck.

Referring now to FIG. 1, the toy transport set of this invention is generally comprised of a trailer 10 which is coupled to a truck cab 11. In this embodiment, the trailer 10 is adapted to carry a plurality of toy automobiles 12, here three in number. The toy cab 11 is conventional in form, and is provided with two pairs of wheels 13 which are mounted on axles (not shown) for rotation. The trailer 10 is likewise provided with matched sets of wheels 14 which are similarly mounted for rotation such that the entire truck assembly is capable of rolling movement.

The trailer 10 is releasably and pivotally coupled to the cab 11 through the use of a simple peg and socket combination. That is, a vertically extending peg or protuberance 15 formed on the rearward portion of the cab 11 is received within a compatably formed socket 16 formed in the bottom of the trailer adjacent one end thereof. The trailer 10 and cab 11 are thus simply joined and can be easily separated. Of course other means for coupling the trailer to the cab may be used, but the instant peg and socket combination has proven to be a simple and expeditious coupling arrangement for both manufacture of the toy transport and manipulation by the child user.

Another advantage of the peg 15 formed on the cab 11 is that the cab functions as a tow truck or wrecker when uncoupled from the trailer (FIG. 3). To this end, the toy cars 12 are provided with detents or depressions 16*a* in which the peg 15 is received. It will be noted that the height of the peg 15 and the depth of the detents 16*a* are sufficient to provide a small clearance between the rear wheels of the cab 11 and those of the towed car.

The trailer 10 is composed of three elements, namely a middle or main body portion 17 and forward and rearward end portions 18 and 19, respectively. All of the components of the toy transport set may be advantageously made out of a suitable plastic, with the various components blow molded to reduce the weight and cost of the toy. The main body portion 17 has a substantially semi-circular surface 20 which will hereafter be referred to as an upper or exterior surface in light of its position in the bridge configuration, which will be described in detail hereafter. The main body portion 17 also has a substantially flat bottom surface 21, with the upper surface 20 and bottom surface 21 meeting at either end of the main body portion in rounded off ends 22. A cavity 23 is formed within the main body portion 17 having laterally open sides. In this embodiment, the cavity 23 generally follows the contour of the main body portion and is so sized to easily receive therein one of the toy cars 12.

Since it is desired to provide a toy trailer which is generally in the form of a rectangular solid and thus reminiscent of actual trailers, the end portions 18 and 19 are complimentarily tapered to match the contour of the upper surface 20 and are provided with generally squared off exterior surfaces 24 and 25 along the top and sides, respectively, to thereby yield the desired rectangular shape to the trailer 10 when all of the portions are placed in facial engagement. It will be noted that the lateral sides of the trailer portions are generally planar to thereby form the rectangular solid men- tioned.

More particularly, forward end portion 18 has a surface 26 having a concave contour which complimentarily matches approximately half of the upper surface 20 of the main body portion 17. Rearward end portion 19 likewise has a surface 27 which is complimentarily tapered to match up with the remaining half of the upper surface 20 of the main body portion 17. As previously noted, both end portions are otherwise squared off, and may additionally be provided with rounded off edges, as here. For reasons which will be made more apparent, each of the end portions has a lower extremity 28 which has a small horizontal width along the bottom. It may be noted that the horizontal end of the extremity 28 is roughly coplanar with the bottom 21 of the main body portion 17 of the trailer 10 in the transport configuration.

Forward and rearward end portions 18 and 19 are pivotally connected adjacent respective ends 22 of the main body portion 17 by medial links 29 and 30, respectively, as best shown in FIG. 2*a*. Each of the generally flattened links 29, 30 has laterally extending pairs of upper and lower protrusions 31 and 32, respectively, which are received in detents or holes 33 and 34 formed respectively in the main body portion 17 and the end portion 18, 19. The middle segments of the ends 22 of the main body portion 17 are cut away as at 35 to thus receive the links 29, 30, with a like depression or indent formed in the respective end portions 18, 19.

A transport configuration for the trailer 10 is presented with the end portions 18 and 19 pivoted in facial engagement with the upper surface 20 of the main body portion 17. It will be noted that the center of gravity of the portions 18 and 19 is such that this represents a stable configuration for the trailer portions. The toy cars 12 can be carried by the trailer in the cavity 23 as well as on the top 24 of each of the end portions 18 and 19. To this end, depressed areas 36 are provided in the tops 24 which provide an upturned lip or perimeter to retain the cars 12 in place. Of course fewer cars can be employed with the trailer, as desired. trailer, as desired. For example, the tops 24 can be made smooth with a solitary car 12 carried only within the cavity 23.

With reference now to FIG. 2, the trailer 10 is converted into a bridge by uncoupling the trailer 10 from the cab 11 and pivoting outwardly and downwardly the end portions 18 and 19. This defines the bridge configuration for trailer 10. The pivot connection for the end portions is chosen so that a substantially smooth upper surface is provided to the bridge over which toy cars 12 may travel. The horizontal end of the extremity 28 of the end portions 18 and 19 previously mentioned facilitates the formation of this configuration as well as enhances its general stability by providing a horizontal base surface which supports the main body portion 17 at either end. Additionally, the sides 25 of the end portions each abut a vertical edge of the wheel axle mounts 37 which edges thereby serve as stops to further pivotal movement of the end portions. In this bridge configuration, the tops 24 of the end portions 18 and 19 are generally flush with the playing surface. With the main body portion so supported and suspended by the end portions 18 and 19, cars 12 may also pass beneath the bridge, further adding to the versatility of the toy.

In a preferred form of the invention, a medial raised section 40 is provided on the surfaces 20, 26 and 27 which form the bridge surface (FIG. 2*a*). The raised section 40 has a width slightly less than that of the wheel base of the cars 12 to help guide their passage over the bridge.

From the foregoing, it will thus be seen that a convertible toy is disclosed which is capable of transformation from a transport configuration in which the toy is a trailer truck capable of carrying one or more toy vehicles, to a bridge configuration in which the same trailer is converted into a bridge over and under which toy vehicles may travel. Conversion between the two configurations is simply accomplished through the pivoting of connected portions of the trailer body. An additional feature of the toy transport set of this invention unrelated to the convertibility feature of the trailer is the use of the cab as a tow truck, such as for the toy cars.

Thus, while the invention has been described in connection with a certain embodiment, it will be immediately obvious to those skilled in the art that many modifications of structure, arrangement, portions, elements, materials and components can be used in the practice of this invention without departing from the principles of this invention.

What is claimed is:

1. A toy transport vehicle comprising a trailer having a main body portion with a substantially semi-circular upper exterior surface and a substantially flat bottom surface, the two surfaces meeting at either end of the main body portion, and two end portions, the end portions being pivotally connected adjacent respective ends of the main body portion, the end portions each having a surface with a concave contour matching a portion of the upper surface of the main body portion such that the end portions can be pivotally placed in facial engagement therewith and in a transport configuration to defind a substantially rectangular solid for the trailer, the end portions when pivoted outwardly from the main body portion and into a bridge configuration converting the transport trailer into a bridge having a substantially smoothly curving upwardly facing surface over which a toy automobile can move and under which a toy automobile can pass through a passage formed by the main body portion being supported and suspended between the end portions.

2. A toy transport vehicle comprising:

a toy truck having a cab and a trailer, the trailer having a main body portion and end portions pivotable from the main body portion, the trailer being convertible from a first configuration in which the trailer defines a substantially rectangular solid with the end portions pivoted into facial engagement with the main body portion, to a second configuration with the end portions pivoted away from the main body portion in which the trailer functions as a bridge.

3. The toy transport set of claim 2 wherein the cab and trailer are releasably and pivotably coupled by a peg and socket combination, the cab having an upwardly extending peg thereon and the trailer having a downwardly open socket sized to receive the peg therein, a toy vehicle further having a detent formed adjacent an end thereof which will receive the peg of the cab, the cab thereby serving as a tow truck when uncoupled from the trailer.

4. The toy transport vehicle of claim 2 further including at least one toy automobile, the trailer further including means for carrying the toy automobile.

5. The toy transport vehicle of claim 4 wherein the main body portion has a laterally open cavity formed therein, the cavity being substantially contoured to the exterior shape of the main body portion, the cavity being adapted to receive the toy automobile.

6. A toy transport set comprising:

at least one toy vehicle, such as an automobile, and a toy truck having a cab and a trailer, the trailer being releasably coupled to the cab, the trailer having a main body portion with a substantially semi-circular upper exterior surface and a substantially flat bottom surface, the two surfaces meeting at either end of the main body portion, and two end portions, the end portions being pivotally connected adjacent respective ends of the main body portion, the end portions each having a surface with a concave contour matching a portion of the upper surface of the main body portion such that the end portions can be pivotally placed in facial engagement therewith and in a transport configuration to form a trailer, the end portions when pivoted outwardly from the main body portion and into a bridge configuration converting the transport trailer into a bridge having a substantially smoothly curving upwardly facing surface over which a toy vehicle can move and under which a toy vehicle can pass through a passage formed by the main body portion being supported and suspended between the end portions.

7. The toy transport set of claim 6 wherein the end portions each have generally orthogonal exterior facing surfaces in addition to the concave surface, such that in the bridge configuration, the main body portion is supported above and between the two end portions.

8. The toy transport set of claim 7 wherein the pivot connections between the end portions and the main body portions each comprise a medial link fastened adjacent an end of the main body portion and to an end portion adjacent the lower terminus of the concave surface as viewed in the transport configuration, such that the end portions can freely pivot to the bridge configuration and provide a substantially smoothly curving upper surface for the bridge.

9. The toy transport set of claim 7 wherein the middle body portion has a laterally open cavity formed therein to receive a toy vehicle.

10. The toy transport set of claim 9 wherein the cab and trailer are releasably and pivotally coupled by a peg and socket combination.

11. A toy transport set comprising:

at least one toy vehicle, such as an automobile, and a toy truck having a cab and a trailer with the trailer releasable coupled to the cab for movement therewith, the trailer having means for carrying a toy vehicle, the trailer having a transport configuration and a bridge configuration, the trailer further having a middle body portion and two end body portions, the middle body portion having a semi-circular upper surface, the end portions each having a surface with a contour matching about one-half of the semi-circular surface of the middle portion of the trailer and which can be placed in facial relationship with such middle portion, the end portions being otherwise squared off in form, the end portions each being pivotally connected at a lower end to the middle portion, such that in the transport configuration with the end portions pivoted upwardly and in facial relationship with the middle portion, the trailer defines a substantially rectangular solid, and in the bridge configuration with the end portions pivoted downwardly, the trailer forms a bridge having a relatively smoothly curving upper surface over which a toy vehicle can move, the middle portion being supported and suspended between the end portions.

12. The toy transport set of claim 11 wherein the middle body portion has a laterally open cavity formed therein, the cavity being substantially contoured to the shape of the middle body portion, the cavity being adapted to receive a toy car therein.

13. The toy transport set of claim 12 wherein the cab and trailer are releaseably and pivotably coupled by a peg and socket combination, the cab having an upwardly extending peg thereon and the trailer having a downwardly open socket sized to receive the peg therein.

* * * * *